US008277071B2

(12) United States Patent
Anglikowski et al.

(10) Patent No.: US 8,277,071 B2
(45) Date of Patent: Oct. 2, 2012

(54) WALL-MOUNTABLE LIGHT FIXTURE PROVIDING LIGHT HAVING A PARTICULAR DIRECTIONALITY

(75) Inventors: Ronald Edward Anglikowski, Bowling Green, KY (US); David Scott Bullard, Bowling Green, KY (US); Jeremy Lee Prichard, Cave City, KY (US); William Calvin Raper, Sparta, TN (US)

(73) Assignee: HeathCo LLC, Bowling Green, KY (US)

( * ) Notice: Subject to any disclaimer, the term of this patent is extended or adjusted under 35 U.S.C. 154(b) by 371 days.

(21) Appl. No.: 12/059,290

(22) Filed: Mar. 31, 2008

(65) Prior Publication Data

US 2009/0244913 A1 Oct. 1, 2009

(51) Int. Cl.
*F21S 8/00* (2006.01)
*G08B 13/00* (2006.01)

(52) U.S. Cl. ..... 362/147; 340/565

(58) Field of Classification Search ..... 362/147; 340/565

See application file for complete search history.

(56) References Cited

U.S. PATENT DOCUMENTS

| | | | | |
|---|---|---|---|---|
| 5,050,047 | A * | 9/1991 | Viner et al. | 362/552 |
| 5,649,761 | A * | 7/1997 | Sandell et al. | 362/276 |
| 5,662,411 | A * | 9/1997 | Haslam et al. | 362/276 |
| 5,941,630 | A * | 8/1999 | Finke et al. | 362/371 |
| 6,226,440 | B1 * | 5/2001 | Lyons | 385/119 |
| D444,583 | S * | 7/2001 | Boecker | D26/65 |
| 6,781,129 | B2 * | 8/2004 | Leen | 250/342 |
| 6,909,239 | B2 | 6/2005 | Gauna | |
| 6,956,493 | B1 * | 10/2005 | Youngblood | 340/693.9 |
| 7,182,487 | B1 * | 2/2007 | Pickard et al. | 362/368 |
| 7,339,471 | B1 * | 3/2008 | Chan et al. | 340/541 |
| 2003/0123252 | A1 * | 7/2003 | Cercone et al. | 362/147 |
| 2004/0062055 | A1 * | 4/2004 | Rozenberg et al. | 362/555 |
| 2006/0092338 | A1 * | 5/2006 | Sakai et al. | 348/744 |
| 2008/0062691 | A1 * | 3/2008 | Villard et al. | 362/252 |
| 2008/0276509 | A1 * | 11/2008 | Yu | 40/570 |

OTHER PUBLICATIONS http://staytondailyphoto.com/labels/nighttime.html; Photolog Dated Nov. 6, 2006.

Summary of Disclosure of Hampton Products Concept Boards; Aug. 10, 2012.

* cited by examiner

*Primary Examiner* — Jennifer Mehmood
*Assistant Examiner* — Andrew Bee
(74) *Attorney, Agent, or Firm* — Fitch Even Tabin & Flannery LLP

(57) ABSTRACT

A path-illuminating wall-mountable light fixture (100) can comprise a wall-mountable support platform (101) that is configured and arranged to be installed on a wall (701) and at least a first light aperture (102) that is operably coupled to the wall-mountable support platform. This first light aperture is configured and arranged so that electrically-sourced light (110) emanating from the first light aperture is directed in a first direction that is substantially parallel to the wall, substantially non-perpendicular to the wall, and less than horizontal. When inclusive of a second such light aperture (104), the second light aperture can offer similarly oriented emanated light in a direction that is substantially the opposite of this first direction. By one approach, the light emanating from this (or these) light aperture(s) can be responsive to an animate object detector (107).

5 Claims, 4 Drawing Sheets

WALL-MOUNTABLE LIGHT FIXTURE PROVIDING LIGHT HAVING A PARTICULAR DIRECTIONALITY

TECHNICAL FIELD

This invention relates generally to security and/or convenience lighting that is automatically responsive to animate object detection.

BACKGROUND

Electrically-powered lighting finds myriad applications. This can include, but is not limited to, serving a security function, serving a convenience function, serving a decorative function, and so forth. In some application settings an end user may intend a given light to serve more than one such purpose. For example, a given light may serve both to provide convenience (by, for example, lighting the way for an authorized person) and to serve a security purpose (by, for example, attracting attention that may be unwanted by an unauthorized person and that may prompt such an individual to leave).

Some light sources work in conjunction with, and are responsive to, an animate object detector. In a typical scenario employing such components, the light source is energized when the animate object detector senses a local presence of an animate object (such as a person (authorized or unauthorized), a vehicle, a feral, animal, or the like. This can serve to provide light that will, in turn, hopefully attract attention which may then prompt the animate object to leave the area and/or that will facilitate providing pathway illumination for an authorized person.

Though often a successful security strategy, such an approach does not necessarily meet the needs of all potential application settings. For example, in some cases such illumination can be bothersome to a neighbor. Such a problem can easily arise, for example, when using such a lighting strategy in an alleyway or other relatively narrow pathway between two adjoining properties. In these cases, the resultant illumination lights not only the pathway itself but portions of the adjoining property. This can lead to an annoying intermittent passage of light through the windows of the adjoining property. This can also result in falsely triggering automatic devices located on the adjoining property that rely upon ambient light detection.

BRIEF DESCRIPTION OF THE DRAWINGS

The above needs are at least partially met through provision of the A wall-mountable light fixture providing light having a particular directionality described in the following detailed description, particularly when studied in conjunction with the drawings, wherein.

Figure 1:
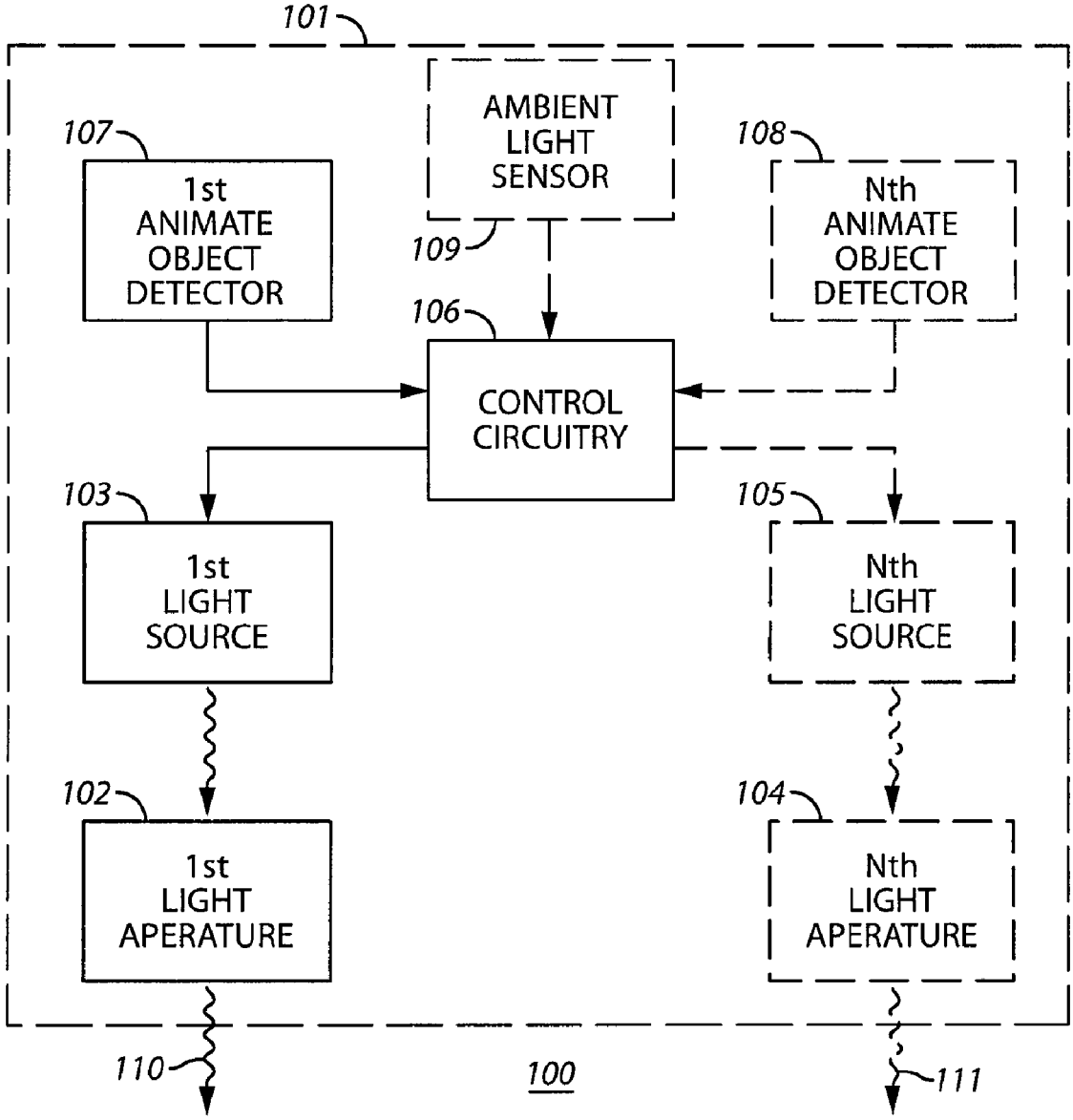
FIG. 1 comprises a block diagram as configured in accordance with various embodiments of the invention.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a path-illuminating wall-mountable light fixture can comprise a wall-mountable support platform that is configured and arranged to be installed on a wall and at least a first light aperture that is operably coupled to the wall-mountable support platform. This first light aperture is configured and arranged so that electrically-sourced light emanating from the first light aperture is directed in a first direction that is substantially parallel to the wall, substantially non-perpendicular to the wall (including both outwardly of and inwardly towards the wall), and less than horizontal. When inclusive of a second such light aperture, the second light aperture can offer similarly oriented emanated light in a direction that is substantially the opposite of this first direction. By one approach, the light emanating from this (or these) light aperture(s) can be responsive to an animate object detector.

By one approach, the directionality of this emanated light can be substantially non-adjustable. By another approach, the directionality of this emanated light from one or more such light apertures can be adjustable within a limited range of adjustment that does not alter a primary orientation of the aforementioned direction. An animate object detector, when provided and if desired, can be configured and arranged to primarily detect an animate object in the direction of the emanated light.

So configured and arranged, those skilled in the art will recognize and appreciate that these teachings provide for a wall-mountable light fixture that can provide useful pathway lighting (for security and/or convenience/safety purposes) in a way that avoids disturbing closely proximal neighbors and neighboring light-sensitive equipment with the resultant illumination. It will further be appreciated that these benefits are attainable with little in the way of on-site adjustments being necessary. Instead, a compliant apparatus can be installed on a given wall at, for example, some general recommended height and provided with mains electricity. The corresponding pathway-illumination that avoids unwanted impingement on perpendicularly-located neighboring property essentially occurs as a necessary by-product of the construction and configuration of the light fixture itself.

These and other benefits may become clearer upon making a thorough review and study of the following detailed description. Referring now to the drawings, and in particular to FIG. 1, various components (optional and otherwise) as correspond to an illustrative path-illuminating, wall-mountable light fixture 100 will be described.

In this illustrative embodiment the wall-mountable light fixture comprises a wall-mountable support platform 101 that is configured and arranged to be installed on a wall. This reference to installation will be understood to refer to a means and method of attaching, by design and with intent, the wall-mountable support platform 101 to a substantially vertical wall. As such, this expression will be understood to not encompass a state of attachment that is only owing to happenstance, chance, or coincidence. This being so, the wall-mountable light fixture will typically have a corresponding upper portion and lower portion once installed upon a wall.

There are various ways by which such a wall-mountable support platform can be attached to a wall as will be well understood by those skilled in the art. This can include the use of any of a wide variety of adhesives as well as various attachment members such as impalement members (such as nails and spikes), threaded members (such as screws and bolts), clips, magnets, and so forth. As these teachings are not overly sensitive to any particular selection in this regard, for the sake of brevity and the preservation of clarity, further elaboration in this regard will not be presented here.

This wall-mountable light fixture 100 also comprises at least a first light aperture 102 that is operably coupled to the wall-mountable support platform 101. Generally speaking, this first light aperture 102 is configured and arranged so that light 110 emanating therefrom is directed in a first direction that is (when the wall-mountable light fixture 100 is installed on a wall) substantially parallel to the wall, substantially non-perpendicular to the wall, and less than horizontal. Further details will be provided below in this regard.

By one approach, this first light aperture 102 serves to receive and direct light as emanates from a corresponding first light source 103 that is also supported by the wall-mountable support platform 101. With momentary reference to FIG. 2, this wall-mountable light fixture can further comprise, if desired, a housing 200 that is also operably coupled to the wall-mountable support platform. Such a housing can also serve to house some or all of the components illustrated in FIG. 1 including these light sources and light apertures. In particular, for example, and as will be well understood by those skilled in the art, portions of the housing can serve, at least in part, to direct light from a given one of the light sources to a given corresponding one of the light apertures to contribute, in whole or in part, to the desired directionality described herein.

Referring again to FIG. 1, various known options exist with respect to these light sources. Examples of light sources that can be suitably employed for these purposes include, but are not limited to, a wide variety of replaceable incandescent bulbs and fluorescent bulbs as well as permanently installed light sources such as light emitting diodes. Again, as these teachings are not overly sensitive to any particular selection in these regards, the selection of any particular choice can be left to the designer with an eye towards the particular needs and requirements of a given intended application setting.

As noted above, there can be more than one such light aperture (and/or corresponding light source). To illustrate this point, in FIG. 1 the optional inclusion of an Nth light aperture 104 and an Nth light source 105 is shown in phantom lines (where "N" will be understood to comprise an integer greater than one). By one approach, such a plurality of apertures can be used in cooperation with one another to achieve illumination of a given desired coverage area. In such a case, the emanating light from such apertures may well overlap with one another. By another approach, two or more such apertures may be configured and arranged such that their corresponding light output does not overlap. This can occur, for example, when the first light aperture 102 is oriented to direct light 110 in a first direction and the Nth light aperture 104 is oriented to direct light 111 in a second direction that is different from the first direction.

The energization and de-energization of these light sources can be controlled, if desired, by corresponding control circuitry 106. Those skilled in the art will recognize and appreciate that such control circuitry can comprise a fixed-purpose hard-wired platform or can comprise a partially or wholly programmable platform such as a microprocessor or a microcontroller. All of these architectural options are well known and understood in the art and require no further description here.

By one approach, this control circuitry 106 can be configured and arranged to control the energization of one or more of these light sources 103, 105 in response to at least a first animate object detector 107 that is operably coupled to the wall-mountable support platform 101. This, in turn, permits having the light 110 and 111 that emanates from the first light aperture 102 and the Nth light aperture 104 (respectively) be responsive to this animate object detector 107.

If desired, and as suggested by the illustration provided in FIG. 1, additional such animate object detectors, such as an Nth animate object detector 108, can be similarly provided. In such a case, for example, the first animate object detector 107 can be configured and arranged to primarily detect an animate object in the path of the direction 110 of the light which emanates from the first light aperture 102. Similarly, the Nth animate object detector 108 can be configured and arranged to primarily detect an animate object in the path of the direction 111 of the light which emanates from the Nth light aperture 104. By this approach, if desired, only a light source which corresponds to a direction in which an animate object has been detected need be energized by the control circuitry 106.

Numerous options exist with respect to the animate object detector(s) 107, 108. These animate object detectors might comprise, for example, a passive infrared (PIR)-based detector as are known in the art. Other examples include, but are not limited to, an image-based detector (which operates, for example, using digital photographic images which are processed to detect, via pattern comparisons, the presence of an animate object), a sound-based detector (which operates, for example, using ultrasonic reflections to detect the presence of an animate object), an active light-based detector (such as a laser-based detection system as are known in the art), and so forth.

By one approach, this automated energization of a light source in response to detecting an animate object can persist until some predetermined follow-on event occurs. This might comprise, for example, an absence of detecting the presence of the animate object. This might also comprise, as another example, maintaining this mode of operation until reset by an authorized person. As yet another example, these teachings will accommodate continuing with energization of the light source until a given count or period of time concludes. Upon conclusion of this count or period of time, the control circuitry 106 can then provide for automatically de-energizing the corresponding light source.

This wall-mountable light fixture 100 can also optionally comprise an ambient light sensor 109 that operably couples to the control circuitry 106 to provide information regarding ambient light conditions to the control circuitry 106. The control circuitry 106 can then employ such information, when available, to further inform the energization and/or de-energization of the light sources. At a minimum, for example, this can comprise controlling the emanation of light from the light apertures in response to the ambient light sensor 109 to thereby inhibit such emanation of light in the presence of a given level of ambient light. For example, when the sun is shining brightly in the middle of the day, there will typically be little value in causing a light source to become energized as the resultant illumination is unlikely to be noticed by either an unauthorized trespasser or useful to an authorized person who is traversing the corresponding pathway.

As a second example in these regards, when the ambient light level falls below some given threshold the light source can be controlled to provide some less-than-maximum degree of illumination while still nevertheless providing some amount of lighting. In this case, when and if an animate object detector detects, for example, an unauthorized individual, the light source can then be controlled to provide a brighter, more intense amount of illumination.

Referring now again to FIG. 2, and again as noted above, a housing 200 can serve to contain some or all of the described components. In this illustrative embodiment the housing 200 has a relatively slim depth 201. This can comprise, for example, selecting a housing width 201 such that, when the wall-mountable light fixture 100 is installed on a wall, the first light aperture 102 (and such other light apertures as may be optionally provided) are located no more than (and/or within) four inches away from the wall. The housing 200 itself can be comprised of any suitable material including metal or plastic. Those skilled in the art will recognize that such a housing 200 can have the rectangular shape shown or any of a wide variety of alternative form factors. The selection of any particular choice in this regard can comprise a function of a variety of preferences with respect to esthetics, utility, maintainability, longevity, weather resistance, tamperproofing, and so forth.

Figure 2:
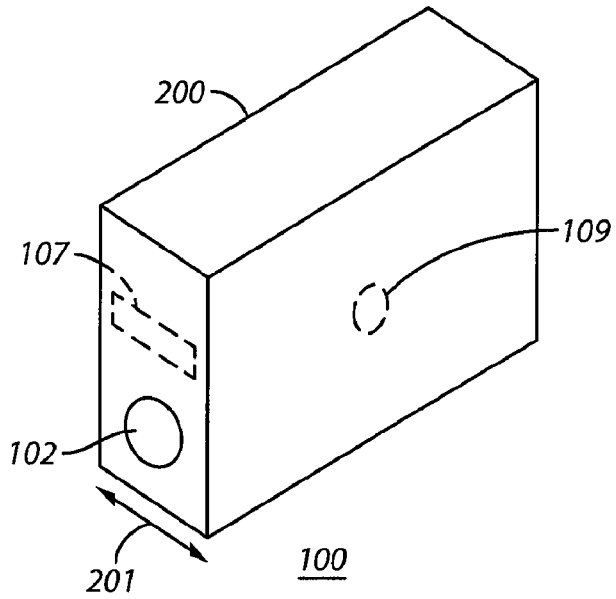
FIG. 2 comprises a perspective view as configured in accordance with various embodiments of the invention.

As illustrated in FIG. 2, by one approach, the first animate object detector 107 can be optionally disposed proximal to the first light aperture 102, or can be otherwise located, so that the animate object detector 107 is particularly sensitive to objects that move within the intended direction 110 of light emanation for the first light aperture 102. FIG. 2 also illustrates that the aforementioned ambient light sensor 109 can be mounted on the front-facing side of the housing 200 in order to be afforded a relatively clear view of ambient lighting conditions.

If desired, when there are two light apertures, the second light aperture (not shown in FIG. 2) can be disposed on the side of the housing 200 that is opposite the side having the first light aperture 102. So configured, the resultant wall-mountable light fixture 100, when installed on a wall, can provide light from the first light aperture 102 in a first direction 110 and light from the second light aperture in a second direction 111 that is substantially opposite to the first direction 110.

Figure 3:
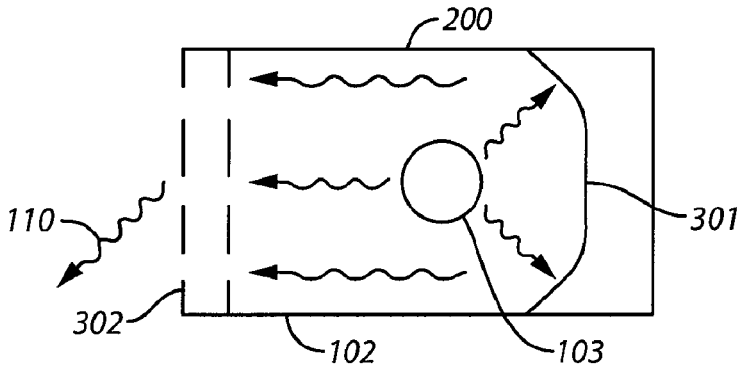
FIG. 3 comprises a side elevational schematic view as configured in accordance with various embodiments of the invention.

Referring now to FIG. 3, the first aperture 102 can serve, as described above, to direct light from the first light source 103 outwardly of the wall-mountable light fixture in a corresponding first direction 110. By one approach, if desired, this can comprise, in part, use of a reflector 301 to aid in redirecting some light in favor of this preferred direction. In particular, this reflector 301 can be configured and arranged to reflect at least some light from the first light source 103 more towards the first direction 110. Reflectors are known in the art and include various shapes (such as flat and various concave form factors) to achieve the desired result. It is also known to use more than one reflector if desired for these purposes. Such a reflector can be comprised of any of a variety of materials including metal and plastic substrates. (When using a plurality of light sources and/or a plurality of light apertures, these teachings will of course accommodate using a corresponding plurality of reflectors if desired.)

FIG. 3 also illustrates that the first light aperture 102 can also comprise, if desired, a first lens 302 that is supported by the housing 200 and that is configured and arranged to direct at least some light from the first light source 103 (including, as appropriate, both direct light and reflected light) in the first direction 110. As desired, other light apertures as may be provided in a given application setting can be similarly provisioned.

Lens structures and performance comprises a very well known area of endeavor. Those skilled in the art will recognize that any of a variety of lens can be employed for these purposes including but not limited to Fresnel lenses. As illustrated, this lens can be configured of corresponding facets and the like to bend the light emanating from the light source 103 in order to cause the light emanating from the first light aperture 102 to correspond with the first direction 110.

By one approach, the light apertures (including the aforementioned lenses when available) can comprise fixed elements that permit essentially no adjustability with respect to the direction by which light emanates from the light apertures. The direction 110 itself can be based upon a presumption, for example, that an installed location for the wall-mountable light fixture 100 is between, say, ten and twelve feet above the ground to be illuminated.

Figure 4:
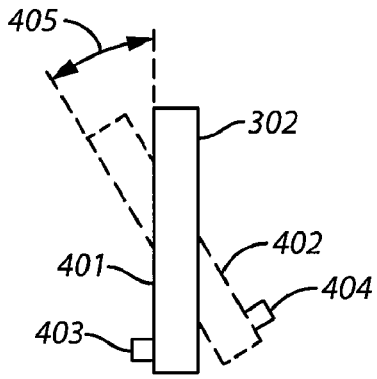
FIG. 4 comprises a side elevational detail schematic view as configured in accordance with various embodiments of the invention.

By another approach, if desired, this direction 110 can be made adjustable within a limited range of adjustment. This could be accomplished, for example, by configuring the entire light aperture to pivot about one or more axis's of movement. By another approach, and referring now to FIG. 4, the lens 302 itself can be formed as a pivoting (or otherwise movable) component. By this approach, the lens 302 can be permitted to move from a first position (denoted by reference numeral 401) to a second position (denoted by reference numeral 402) over an allowable range 405 of movement. A first stop 403 can serve, for example, to define the extent of the first position 401 while a second stop 404 can serve a similar purpose for the second position 402. By one approach, for example, this limited range of adjustment 405 can comprise an adjustment range of no more than 30 degrees.

Figure 5:
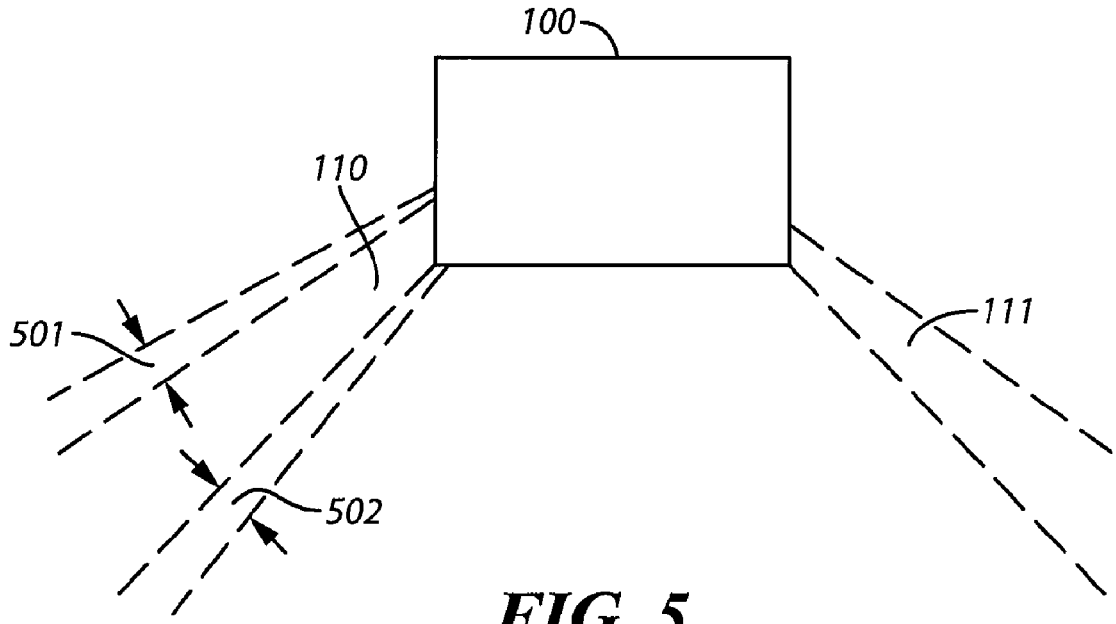
FIG. 5 comprises a side elevational view as configured in accordance with various embodiments of the invention.

With reference now to FIG. 5, in one illustrative embodiment, the wall-mountable light fixture 100 can emit a first beam of light in the aforementioned first direction 110 and a second beam of light in the aforementioned second direction 111 (which, in this illustrative embodiment, essentially comprises an opposite direction). In this particular example, the first beam of light has an adjustable direction of propagation as described above such that the beam can be adjusted slightly upwardly within a given small range of adjustability 501 or slightly downwardly within a given small range of adjustability 502. These two ranges of adjustability (501 and 502) may, or may not, be equal to one another as measured from, for example, some initial default factory setting.

Figure 6:
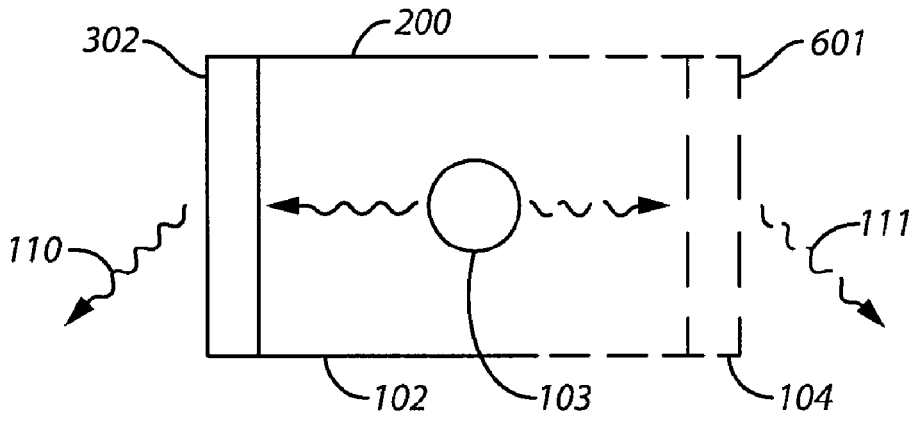
FIG. 6 comprises a side elevational schematic view as configured in accordance with various embodiments of the invention.

In the illustrative examples provided above, each light aperture has been shown in combination with a discrete corresponding light source. Referring now to FIG. 6, however, it can be seen that a plurality of light apertures 102 and 104 can share a single light source 103 if desired. If desired, in such a case both apertures can be provided with a corresponding lens such that the second light aperture 104 has a corresponding lens 601 to aid in directing the light emanating therefrom.

Figure 7:
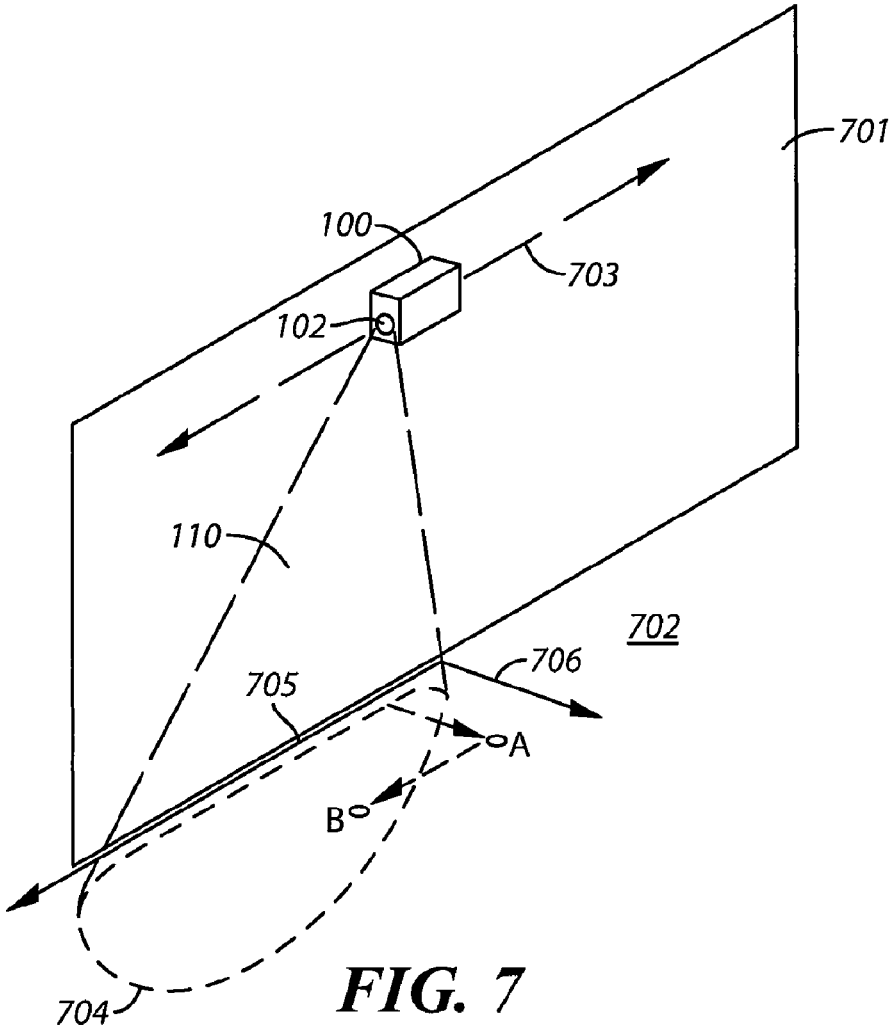
FIG. 7 comprises a perspective view as configured in accordance with various embodiments of the invention.

Referring now to FIG. 7, an illustrative example of the wall-mountable lighting fixture 100 as installed will be described. In this example the wall-mountable lighting fixture 100 has been mounted near the top of a wall 701 (such as, but not limited to, an exterior side of a building). In this example, for the sake of clarity and simplicity, light is only shown to emanate from the first light aperture 102. Those skilled in the art will recognize that what is now expressed with respect to this light will apply, for example, to light that emanates from a light aperture on an opposing side of the housing.

As noted earlier, light emanates from the first light aperture 102 in a first direction 110. This light illuminates the ground 702 adjacent the wall 701 and is clearly shown to be directed in a direction 110 that is less than horizontal (as denoted by reference numeral 703). This light is also shown to form an illumination coverage area 704 on the ground 702 that corresponds to the direction 110 being both substantially parallel (as denoted by reference numeral 705) to the wall 701 and substantially non-perpendicular (as denoted by reference numeral 706) to the wall. For example, by one approach, the light that emanates from the first light aperture 102, at a perpendicular distance of ten feet from the wall 701 (as denoted, for example, by "A") is at least eighty percent less intense or bright than light emanated from the first light aperture 102 at a same distance that is parallel to the wall 701 (as denoted, for example, by "B").

Figure 8:
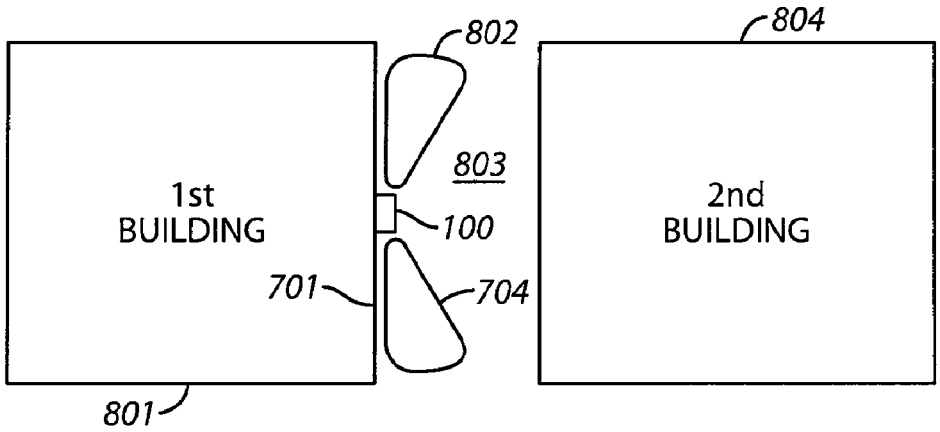
FIG. 8 comprises a top plan view as configured in accordance with various embodiments of the invention.

FIG. 8 provides a top plan view of this same installation and configuration scenario. So configured, the wall-mountable lighting fixture 100 as mounted on the wall 701 of a first building 801 provides pathway illumination 704 (and 802, presuming a second light aperture configured to direct its light substantially opposite to the first light aperture) for a pathway 803 between the first building 801 and a second building 804 while avoiding projecting light directly at the second building 804. These teachings are therefore seen to achieve the desired purposes of security and convenience/safety while avoiding the aforementioned problems of projecting annoying and bothersome light at unappreciative neighbors.

Those skilled in the art will recognize and appreciate that these teachings are highly flexible and will accommodate a wide variety of form factors, light sources, light apertures, and other components. These teachings are also very scalable and will provide benefits over a range of modest application settings to more extravagant application settings. It will further be understood and appreciated that these teachings can be readily applied by leveraging existing technologies and methodologies.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A wall-mountable light fixture comprising:

a stationary wall-mountable housing that is configured and arranged to be installed on a vertical wall;

a first light aperture that is disposed within the stationary wall-mountable housing and directed in a first direction, wherein the first light aperture is configured to direct light emanating from the stationary wall-mountable housing, wherein the light and the first light aperture are directed:

in a plane parallel to the vertical wall;

non-perpendicularly from the vertical wall; and downwardly from the horizontal;

a second light aperture that is disposed within the stationary wall-mountable housing and directed in a second direction, wherein the second light aperture is configured to direct light emanating from the stationary wall-mountable housing, wherein the light and the second light aperture are directed:

in a plane parallel to the vertical wall;

non-perpendicularly from the vertical wall; and downwardly from the horizontal;

wherein the first light aperture and the second light aperture share a light source;

wherein following installation of the stationary wall-mountable housing, the first light aperture and the second light aperture are configured such that light emanating from the stationary wall-mountable housing cannot be pointed perpendicularly from the vertical wall.

2. A wall-mountable light fixture comprising:

a stationary wall-mountable housing that is configured to be installed on a vertical wall;

a light source disposed in the stationary wall-mountable housing;

a first light aperture that is disposed within the stationary wall-mountable housing and directed in a first direction, wherein the first light aperture is configured to direct light emanating from the light source out of the stationary wall-mountable housing:

in a plane parallel to the vertical wall, non-perpendicularly from the vertical wall, and downwardly from the horizontal;

a second light aperture that is disposed within the stationary wall-mountable housing and directed in a second direction, wherein the second light aperture is configured to direct light emanating from the light source out of the stationary wall-mountable housing:

in a plane parallel to the vertical wall, non-perpendicularly from the vertical wall, and downwardly from the horizontal;

wherein following installation of the stationary wall-mountable housing, the first light aperture and the second light aperture are configured such that light emanating from the stationary wall-mountable housing cannot be pointed perpendicularly from the vertical wall.

3. The wall-mountable light fixture of claim 2 wherein the light source comprises at least two light creating elements configured to operate together to provide light to both the first light aperture and the second light aperture.

4. A method of providing light from a wall-mountable light fixture, the method comprising:

lighting a light source disposed in a stationary wall-mountable housing that is configured to be installed on a vertical wall;

a first light aperture that is disposed within the stationary wall-mountable housing and directed in a first direction directing light emanating from the light source out of the stationary wall-mountable housing:

in a plane parallel to the vertical wall, non-perpendicularly from the vertical wall, and downwardly from the horizontal;

a second light aperture that is disposed within the stationary wall-mountable housing and directed in a second direction directing light emanating from the light source out of the stationary wall-mountable housing:

in a plane parallel to the vertical wall, non-perpendicularly from the vertical wall, and downwardly from the horizontal;

wherein following installation of the stationary wall-mountable housing, the first light aperture and the second light aperture are configured such that light emanating from the stationary wall-mountable housing cannot be pointed perpendicularly from the vertical wall.

5. The method of claim 4 wherein the lighting the light source comprises lighting at least two light creating elements operating together to provide light to both the first light aperture and the second light aperture.

* * * * *